United States Patent [19]

Fujimagari et al.

[11] Patent Number: 4,949,532

[45] Date of Patent: Aug. 21, 1990

[54] COIN PACKAGING DEVICE

[75] Inventors: Sachio Fujimagari, Tokyo; Seiji Mizusaki; Noboru Nishizawa, both of Ueda, all of Japan

[73] Assignees: Musashi Engineering Kabushiki Kaisha, Tokyo; Ueda Japan Radio Co., Ltd., Ueda, both, Japan

[21] Appl. No.: 269,476

[22] Filed: Nov. 9, 1988

[30] Foreign Application Priority Data

Nov. 13, 1987 [JP] Japan ..... 62-285277

[51] Int. Cl.[5] ..... B65B 11/04

[52] U.S. Cl. ..... 53/542; 53/212; 53/532; 453/31; 453/56; 198/417

[58] Field of Search ..... 453/31, 32–35, 453/56, 59; 53/212, 254, 532, 542; 198/417

[56] References Cited

U.S. PATENT DOCUMENTS

| | | | |
|---|---|---|---|
| 793,562 | 6/1905 | Broga | 453/12 |
| 998,830 | 7/1911 | Batdorf | 53/532 X |
| 1,022,902 | 4/1912 | Ware | 53/532 X |
| 1,038,361 | 9/1912 | Hart | 53/532 X |
| 3,756,586 | 9/1973 | Craft | 198/417 X |

*Primary Examiner*—F. J. Bartuska

*Attorney, Agent, or Firm*—Brooks, Haidt Haffner & Delahunty

[57] ABSTRACT

This invention relates to a coin packaging device. More particularly, it relates to a coin packaging device in which coins despatched in the prone state change their position to the upstanding state and in which a coin stack comprised of coins in an intimately contacted aligned upright state is transferred to a packaging section.

4 Claims, 10 Drawing Sheets

COIN PACKAGING DEVICE

BACKGROUND OF THE INVENTION

1. Field of the Invention

This invention relates to a coin packaging device. More Particularly, it relates to a coin packaging device in which coins despatched in the prone state change their position to the upstanding state and in which a coin stack comprised of coins in an intimately contacted aligned upright state is transferred to a packaging section so that the coins can be packaged quickly and reliably without clogging or loss of coins.

2. Prior Art

Various systems have been proposed for coin packaging including a series of process steps such as coin transport, stacking and packaging, in connection with a coin packaging system. An illustrative example is shown in a Japanese Utility Model Publication No. 24803/1983 and shown herein in FIGS. 1 and 2.

Referring to these figures, coins 201 supplied on a rotating disk 200 in a hopper section are despatched one by one by the centrifugal force generated during rotation of the rotating disk 200. The coins are then transported sequentially on a coin transport channel 202 by a transport belt 231. During such transport, the coins 201 are passed through a sorting opening 204 formed by a stationary member 202*a* and a movable member 202*b* and only designated coins are guided into a coin collecting tube 207 via a coin count unit formed by a recess 206 in the stator gear 205. On the other hand, coins other than the designated coins that are dropped into the opening as the small diameter coins as a result of sorting on the channel 202 based on the coin diameter are guided to a reject section 208.

The designated coins guided in the coin collecting tube 207 are heaped on a shutter 209 provided at a lower position of the coin guide tube 207. At a lower position of the coin collecting tube 207, a plurality of packaging rolls 210, 211 and 212 are provided for rotation and separately in the vertically extending position. As the packaging rolls 210 to 212 are shifted in the bundle-forming direction relative to one another, a coin packaging section 213 is formed by a hollow portion.

Hence, when a predetermined number of, such as fifty, coins are heaped on the shutter 209, a coin holder 214 provided in the packaging section 213 so as to be movable vertically is raised to a position directly below the shutter 209. The shutter 209 is then opened to permit the heaped coins to descend on the coin holder 214.

Then, when the coin holder 214 starts to descend and the coin is disposed within the coin packaging section 213, the packaging rolls 210 to 212 defining the packaging station by a wide space width are moved relative to one another in a direction of narrowing the space width such that the coin packaging section 213 is converted from the state of wide space for introducing the coins thereto to the state of narrow width for clamping the coins.

The stacked coins guided into the coin packaging section 213 and clamped by the packaging rolls 210 to 212 are wrapped by a packaging paper sheet 217 with rotation of the packaging rolls 210 to 212 as the packaging sheet 217 is reeled out by a reelout unit, not shown, and is introduced into a space between the packaging rolls 210 to 212. The both wrapping sides of the packaging paper 217 are then tightened inwardly by pawl members 215*a* and 216*a* at the foremost parts of the paired arms 215 and 216 as these arms are moved to complete a series of packaging operations.

In the above described coin packaging device, the coins despatched from the rotating disk 200 of the hopper are thrusted and transported by a transport belt 231 guided by a plurality of rolls 230 provided on the coin transport passage 202. After coin sorting and counting are performed halfway on the transport belt 231, the coins are heaped in the coin collecting tube 207 via guide member 232 at the terminal end of the belt 231. However, when the coins are heaped in this manner as they descend by gravity, it may occur that the coins be injected in the upright condition as shown at 201*a*. In such event, it becomes impossible to heap a predetermined number of coins, so that the coins in the tube need be discharged as poorly stacked or clogged coins by an extremely complicated and time- and labor-consuming operation.

For avoiding such irregular heaping, it becomes necessary to switch the heaping tubes depending on the different coin diameters with different coin sorts or to use a complicated heaping tube formed by split members so as to enable the inside tube diameter to be changed as a function of the coin diameters. Also it becomes necessary to provide means for sensing the uppermost coin position in the tube as by a photosensor or checking for the possible presence of the upright coins. This results in an extremely complicated arrangement of the coin packaging unit and tremendous costs.

In addition, for transferring the coins from the tube 207 to the coin holder 214, the shutter 209 is opened to cause the heaped coins to descend on the coin holder 214 by gravity so as to be directly transferred to the packaging section 213. Hence, depending on the heaped state of the coins in the tube, the coins may become unbalanced due to the impact caused during descent so that the coins may be eventually lost. The same applies for the transfer of the coins to the coin packaging section.

Although not shown, means for guiding and transporting the stacked coins to the coin packaging section comprised of spacings between the packaging rolls and means for actuating the packaging rolls in a direction of narrowing the spacing widths of the coin packaging section are similarly extremely complicated in construction to increase the complexity of the coin packaging unit and the size of the device with corresponding increase in costs.

It is therefore an object of the present invention to provide a coin packaging device in which coins despatched in the prone state change their position to the upstanding state and in which a coin stack comprises of coins in an intimately contacted aligned upstanding state is transferred to a packaging section for packaging so that the coins can be packaged quickly and reliably without clogging or loss of coins with reduction in size.

In accordance with the present invention, there is provided a coin packaging device for transferring and collecting coins despatched from a turntable, counting, transporting and packaging the coins by groups each containing a predetermined number of coins, said device comprising a coin position inverting section for changing the position of the coins despatched from the turntable from a prone position to an upstanding position, a coin collecting section having a coin collector/-stacker for accommodating the coins in the intimately contacted aligned upstanding position, a transfer section for transferring said coin collector/stacker to a predetermined location and transferring the coins in the intimately contacted aligned upstanding position to a coin packaging section adapted for packaging the coins in the intimately contacting upstanding position.

According to the present invention, there is also provided a coin packaging device for transferring and collecting coins despatched from a turntable, counting, transporting and packaging the coins by groups each containing a predetermined number of coins, said device comprising a coin position inverting section for changing the position of the coins despatched from the turntable from a prone position to an upstanding position, a coin collecting section having a coin collector/-stacker for accommodating the coins in the intimately contacted aligned upstanding position, a transfer section for clamping and transferring said coin collector/-stacker to a predetermined location, and a coin packaging section supplied with the coins in the intimately contacted aligned upstanding position from said transfer section and adapted fro packaging the coins in the intimately contacting upstanding position, the coins being inverted in the positions by a three-dimensional curved surface in said coin position inverting section.

According to the present invention, there is also provided a coin packaging device for transferring and collecting coins despatched from a turntable, counting, transporting and packaging the coins by groups each containing a predetermined number of coins, said device comprising a coin position inverting section for changing the position of the coins despatched from the turntable from a prone position to an upstanding position, a coin collecting section having a coin collector/-stacker for accommodating the coins in the intimately contacted aligned upstanding position, a transfer section for clamping and transferring said coin collector/-stacker to a predetermined location, a coin packaging section supplied with the coins in the intimately contacted aligned upstanding position from said transfer section and adapted for packaging the coins in the intimately contacting upstanding position, and a tension roll section for transferring the coins from said coin position inverting section to said coin collecting section in a stably gripped state.

According to the present invention, there is also provided a coin packaging device for transferring and collecting coins despatched from a turntable, counting, transporting and packaging the coins by groups each containing a predetermined number of coins, said device comprising a coin position inverting section for changing the position of the coins despatched from the turntable from a prone position to an upstanding position, a coin collecting section having a coin collector/-stacker for accommodating the coins in the intimately contacted aligned upstanding position, a transfer section for clamping and transferring said coin collector/-stacker to a predetermined location, a coin packaging section supplied with the coins in the intimately contacted aligned upstanding position from said transfer section and adapted for packaging coins in the intimately contacting upstanding position, and a stacked coin presser arm for enabling the coins to be accommodated in said coin collector/stacker in said coin collecting section independent of the coin size.

In the coin packaging device of the present invention, the coins despatched in the prone position or horizontal position may be inverted by an inverting block member to an upright position and the coins in the upright position are stabilized in their transfer direction in a tension roll section and brought to an intimately contacted horizontally transversely juxtaposed position within a stacker in a standby state in the coin collecting section. The stacker is then shifted to a region in the coin packaging section by corresponding shifting means in the coin collecting section. A predetermined number of stacked coins in the intimately contacted aligned upstanding state may be clamped by pawls and transferred in the clamped state to a set of rolls making up the coin packaging section. As the stacker is returned to its starting position, the stacked coins are packaged in the coin packaging section and the stacked coins wrapped by a packaging paper has its both ends tightened by means of tightening pawls to produce the coin bar.

In the above described coin packaging device of the present invention, the following advantages are occurred.

(i) The coins despatched from the turntable in the prone position may be brought positively to the upstanding position in the coin position inverting section and accommodated in the coin collecting section in the upright position, so that the coins can be collected quickly and reliably in the upright position.

(ii) The stacked coins accommodated in the stacker of the coin collecting section may be shifted in their position by the shifting of the stacker and are transferred on the rolls of the coin packaging section with the both ends of the stacked coins clamped by the clamp section. Therefore, a predetermined number of the coins can be reliably packaged unless counting errors are made.

(iii) The coins are stacked and packaged in the upright aligned juxtaposed state so that the distance traversed by the coins can be reduced. Above all, coin movement in the vertical direction can be improved significantly as compared with the prior-art system, so that the device can be reduced in the longitudinal size to contribute to reduction in the overall size.

BRIEF DESCRIPTION OF THE INVENTION

DESCRIPTION OF PREFERRED EMBODIMENT

Figure 1:
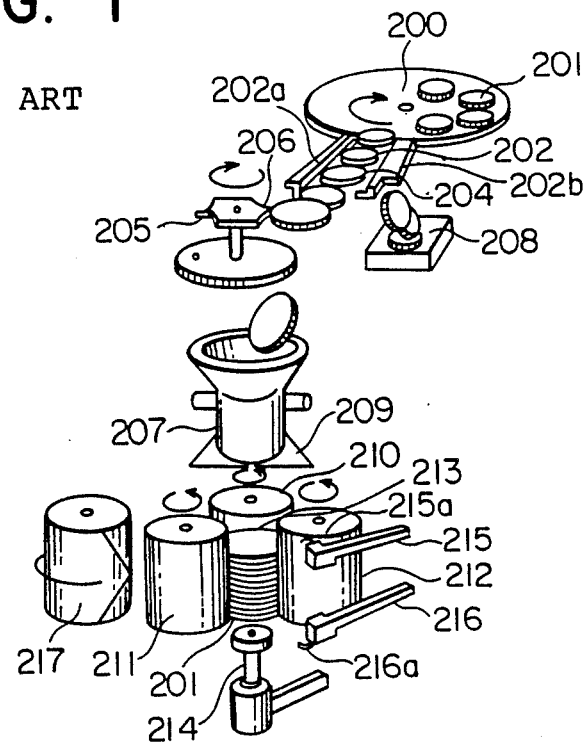
FIG. 1 PRIOR ART
FIGS. 1 and 2 are an exploded perspective view and a side view showing schematically the prior-art coin packaging device.
Figure 2:
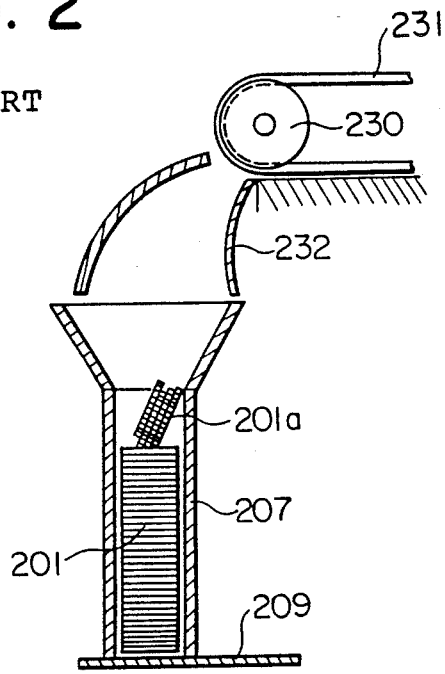
FIG. 2 PRIOR ART

Referring to the drawings, a preferred embodiment of a coin packaging system of the present invention will be explained hereinbelow in detail.

Figure 3:
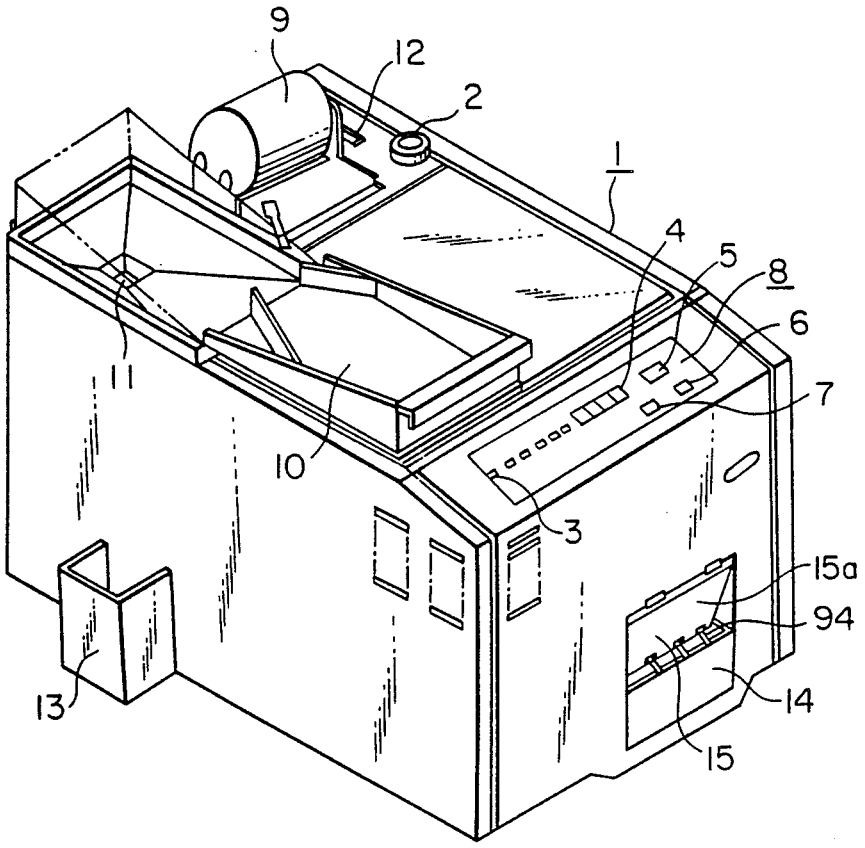
FIG. 3 is a perspective view of the coin packaging device of the present invention.

The system as a whole is shown in perspective in FIG. 3, including a substantially box-shaped main body 1. On the top of the main body 1, there is provided a knob 2 for setting the sort of the coin to be packaged. On the front side of the main body 1, there is provided an operation display unit 8, made up of an emergency display section 3, a count display section 4, a package display changeover switch 5, a start/stop switch 6 and a clear switch 7. In the proximity of the setting knob 2, there are provided a roll type packaging paper sheet 9, a temporary storage hopper 10, a hopper 11 and a power source switch 12.

On the left-hand side of the main body 1 in FIG. 3, there is provided a reject coin receiving box 13. On the front side of the main body 1, there is provided a coin bar outlet 15 including a fractional number coin discharge box 14 and a flap door 15*a*.

FIG. 4 to 11 show the inner structure of the main body 1, part of which is shown only diagrammatically for simplicity.

Figure 4:
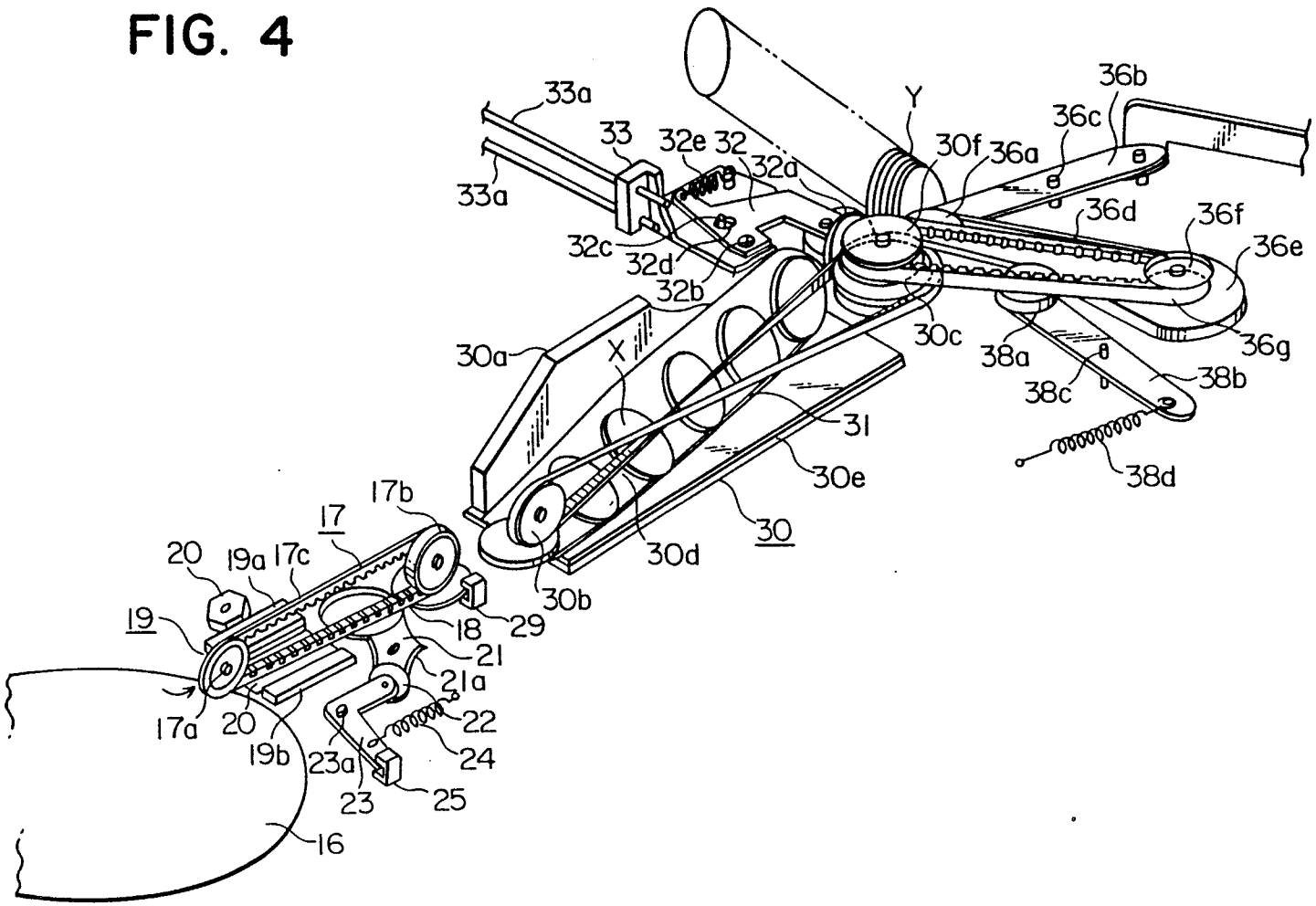
FIG. 4 is a perspective view showing essential parts of a coin despatching section and a coin position inverting section.

In FIG. 4, the coins X placed on a turntable 16 are discharged to the outside under the centrifugal force generated with the rotation of the turntable 16. The turntable is disposed at a lower portion of the hopper 11 shown in FIG. 3 and is connected for rotation to a counting electric motor, not shown. Adjacent to the turntable 16 is a coin drawing-in section for drawing-in of the coins X. The section 17 is made up of pulleys 17*a* and 17*b* and a transport belt 17*c*. On the lower part of the transport belt 17*c* is formed a coin passage 18. Halfway in the coin passage 18, there is provided a coin profile sorting section 19 made up of a movable piece 19*a* and a stationary piece 19*b*.

The sorting section 19 is actuated in association with actuation of the coin sort setting knob 2 to cause the rotation of a coin indicating cam 20, such that the movable piece 19*a* is correspondingly shifted to set the width of a sorting hole 20 provided in the coin passage 18 in correspondence with the diameter of the coin as set on the knob 2.

On one downstream side of the sorting hole 20, there is mounted for rotation a star wheel 21 having plural peripheral recesses 21*a*. In abutment with one of these recesses, a stop wheel 22 is mounted for rotation to one end of a stop wheel holder 23. This stop wheel holder has its other end associated with a spring 24 and is thereby urged for rotation via a pivot shaft 23*a*. A coin count sensor 25 is provided at the other end for sensing the number of revolutions of the star gear 21.

Figure 9:
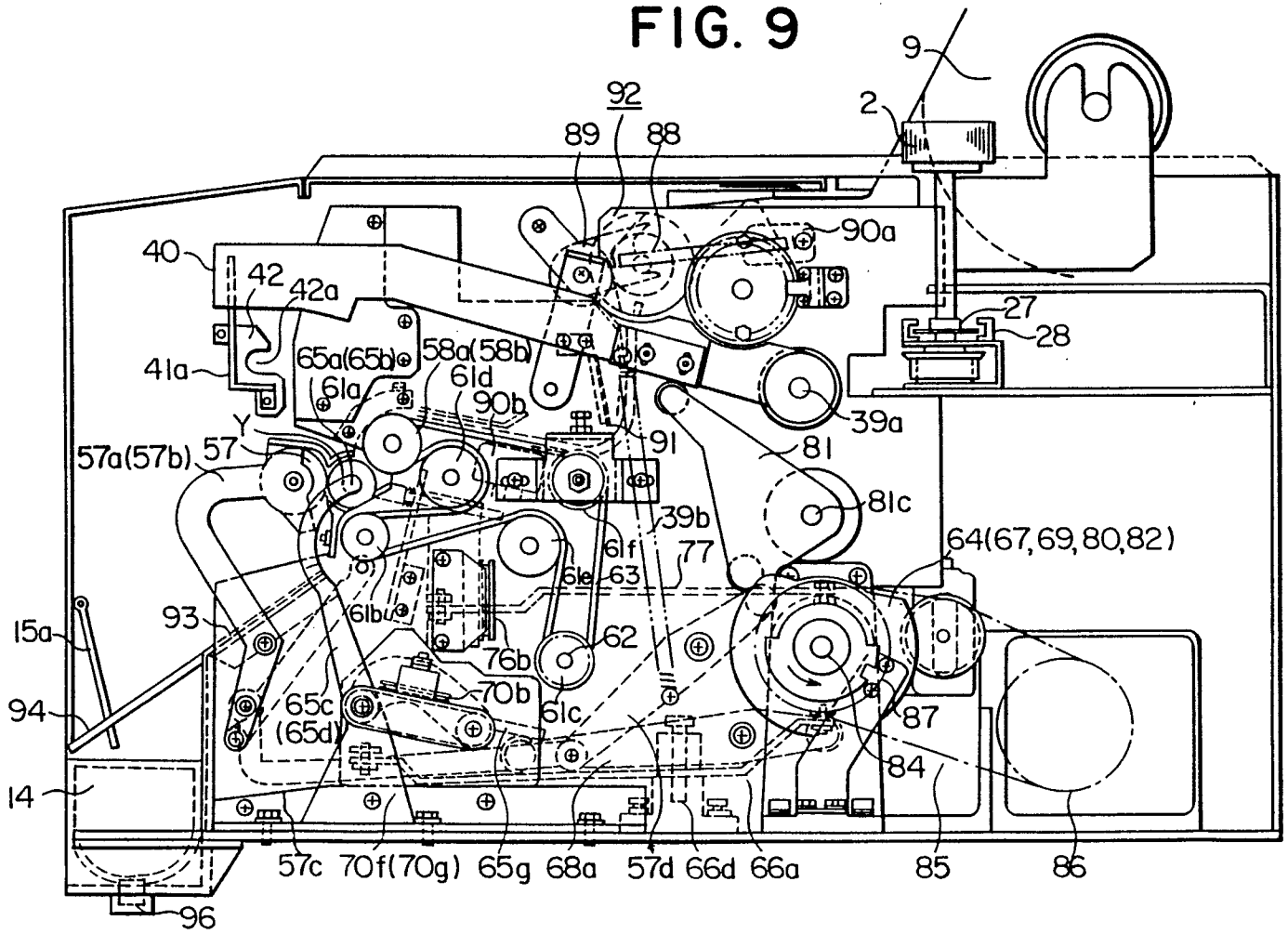
FIG. 9 is a side view similar to FIG. 8 but showing the parts thereof in the operating states.

A slitted disk 27 having plural peripheral slits is mounted coaxially and for rotation in unison with the coin sort setting knob 2, as shown in FIG. 9. On the perimeter of the slitted disk 27, a plurality of coin sort setting sensors 28 are provided for issuing output signals in accordance with the setting of the coin sorts.

On the coin channel 18 and downstream of the star gear 21, there is provided a coin material sensor 29. Adjacent to the outlet side of the drawing-in section 17, there is provided a coin position inverting section 30 having another coin passage 31 contiguous to the coin passage 18. This coin position inverting section 30 is made up of a guide plate 30*e*, an inverting block of a predetermined length 30*a* having a three-dimensional curved surface, a pair of rotatable pulleys 30*b* and 30*c* spaced at a predetermined distance from each other, and a transport belt 30*d*. On the coin passage 31 formed by these members, the coin X is gradually changed in its posture by 90° from the prone or horizontal position to an upstanding or perpendicular position.

Figure 5:
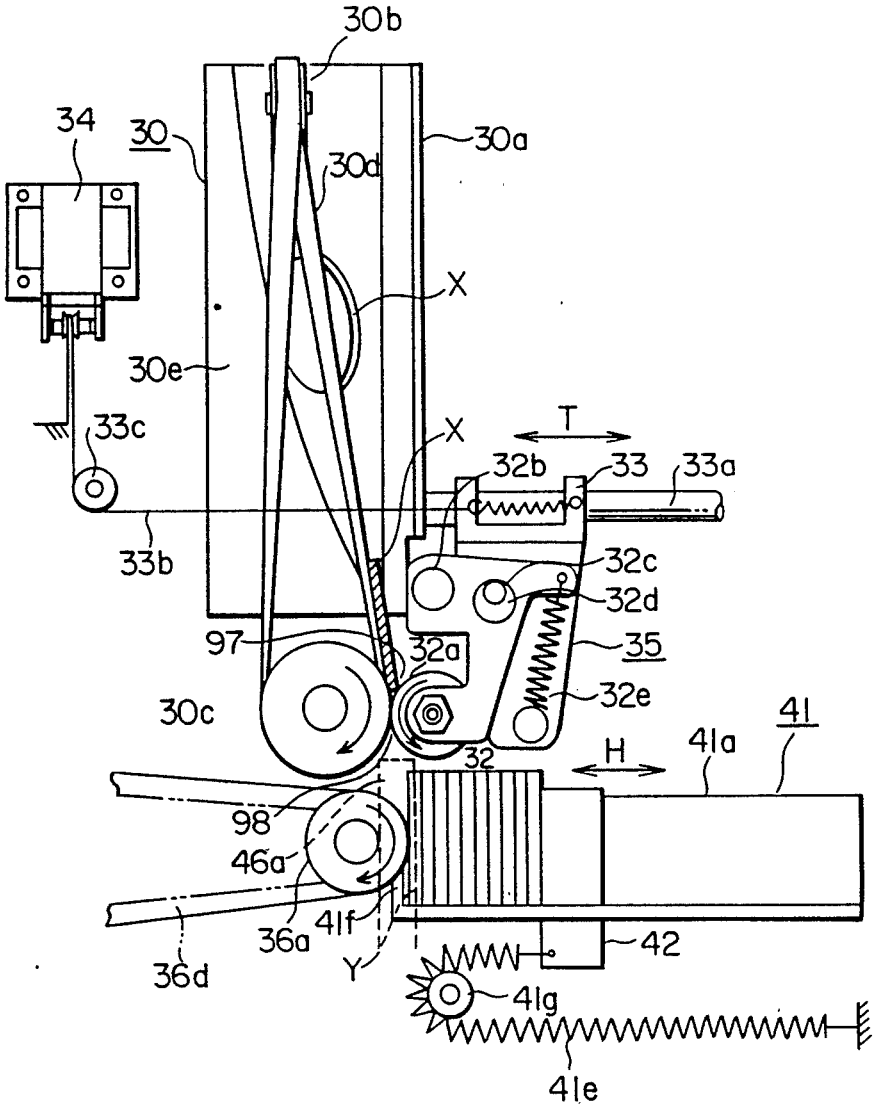
FIG. 5 is a diagrammatic plan view showing essential parts of a tension roll section and a coin collecting section.

Adjacent to the pulley 30*c*, provided to the outlet of the coin inverting section 30, there is provided a substantially J-shaped tension roll arm 32, as also shown in FIG. 5. The tension roll arm 32 is provided at the horizontally extending portion of an L-shaped base block 33 slidably supported on a pair of guide rods 33*a*. A tension roll 32*a* is mounted for rotation at one end of the tension roll arm 32. The tension roll arm is mounted on a pivot shaft 32*b* for pivoting within a limited extent defined by a through-hole 32*d* in which is engaged an upright stud shaft 32*c* on the base block 33. The tension roll arm 32 has its other end associated with a spring 32*e* biasing the tension roll arm 32*a* into abutment with the pulley 30*c*.

The base block 33 is coupled via a wire 33*b* and a pulley 33*c* to a fractional number coin discharge solenoid 34 disposed on the lateral side of the coin position inverting section 34. Upon actuation of the fractional number coin discharge solenoid 34, the base block 33 is adapted to be shifted for abutting the tension roll 32*a* with the pulley 30*c*, the tension roll 32*a* and the tension roll arm 32 making up a tension roll unit 35 for affording a force of biasing the coin X. The numeral 33*d* denotes a return spring for the base block 33. On the underside of the base block 33, there is provided a coin count sensor, not shown, for counting the number of the coins stacked on a coin collector/stacker 41*a* as later described.

In opposition to the tension roll 32*a* and adjacent to the pulley 30*c*, there is rotatably provided a pulley 36*a* to one end of a pulley shift arm 36*b*. The pulley 36*a* may be operatively linked with the pulley 36*e* via a belt 36*d*. The other end of the pulley shift arm 36*b* is connected to a pulley shift solenoid 37. When the pulley shift solenoid 37 is energized, the pulley shift arm 36*b* is turned about pivot shaft 36*c* to shift the pulley 36*a* towards a coin collector/stacker 41*a* as later described.

The belt 36*d* is mounted loosely with a play between the pulley 36*a* and the pulley 36*e*. On the outer lateral surface of the belt 36*d*, a tension roll 38*a* mounted to one end of a tension arm 38*b* rotatable about pivot shaft 38*c* is abutted at all times under the force of a spring 38*d* connected to the other end of the tension arm 38*b*. On the top of the pulley 36*e*, there is coaxially and fixedly mounted a counterpart pulley 36*f*. Similarly, on the top of the pulley 36*c* of the coin inverting section 30, there is coaxially and fixedly mounted another counterpart pulley 36*f*. These pulleys 30*f* and 36*f* are connected together by a belt 36*g*.

Upon actuation of the count motor, not shown, rotation of the count motor is transmitted to the transport belt 17*c* and to the aforementioned coaxially fixedly mounted pulleys 36*e* and 36*f*, thence to the other coaxially fixedly mounted pulleys 30*c* and 30*f* and finally to the transport belt 30*d*.

Within a space facing to the pulley 36*a* on the front side and also facing to the tension roll unit 35 on the front side, there is mounted a coin collection unit 41 provided with a coin collector/stacker 41*a* adapted to collect the coins in the horizontal transverse direction as the coins are transported thereto from the coin position inverting section 30 with the edges on end.

Figure 6:
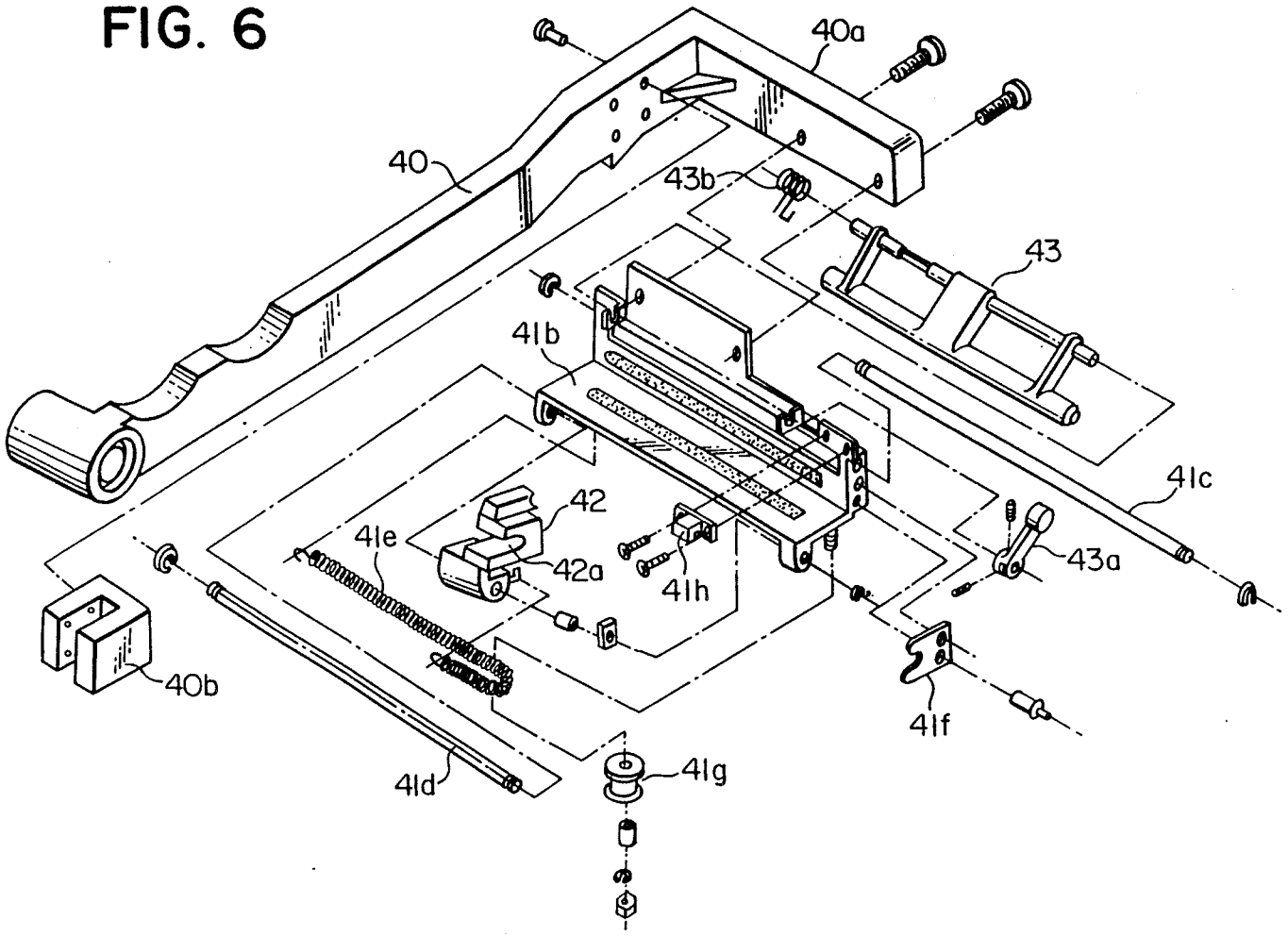
FIG. 6 is an exploded perspective view showing a coin collector/stacker.

The coin collector/stacker 41*a* is mounted, as shown in FIGS. 5 and 6, at a bent portion 40*a* of an L-shaped holding arm 40 adapted to hold the coin collecting unit 41. The holding arm 40 is mounted to a side plate 39 in the main body for rotation vertically by a pivot shaft 39a and for sliding via a guide member 40b.

The coin collector/stacker 41a includes a substantially L-shaped coin support plate 41b and a slider 42 having a substantially U-shaped recess 42a. The slider 42 is supported by slide rods 41c and 41d mounted to the rear and bottom sides of the coin support plate 41b and mounted for sliding against the bias of a spring 41e as it holds the coin support plate 41b. The coin collector/-stacker also includes a stacked coin presser arm 43 rotatably mounted on top of the coin support plate 41b and a side member 41f provided on the lateral side of the coin support plate 41b for preventing accidental descent of the coins. A lever 43a is integrally secured to one end of a shaft section of the presser arm 43, which presser arm is adapted to thrust and hold the coins by a spring 43b operatively associated with the other end of the shaft section. The numeral 39b denotes a spring for additionally urging the stacked coin holding arm 40 downward, the numeral 41g a pulley for holding the spring 41e and the numeral 41h a sensor for ascertaining that the slider 42 has been returned to its starting position.

Figure 7:
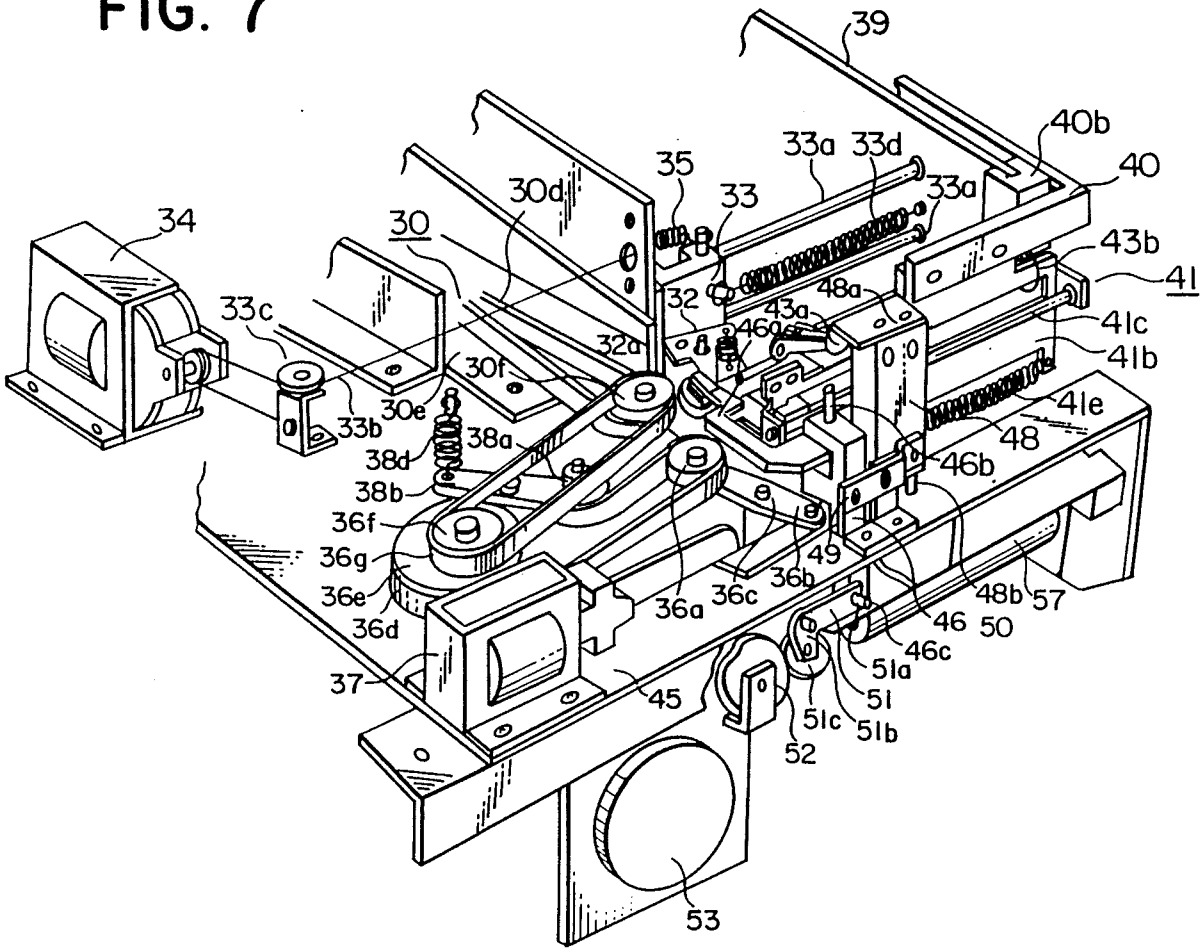
FIG. 7 is a perspective view showing essential parts of a coin transport system.

On the rear side of the coin collector/stacker 41a, there are mounted, as shown in FIG. 7, a vertically movable member 46 that is mounted to be passed through a base plate 45 of the main body and through which a slide rod 46b mounted upright on the base plate 45 is passed as a pivot shaft, and a vertical regulating member 46a integrally mounted to the member 46 and having its foremost part extending above the coin stacking position defined by the pulley 36a and the slider 42. Adjacent to the vertically movable member 46, there is mounted a counterpart vertically movable member 48 which is adapted to be movable vertically and through which are passed two slide rods 48b mounted upright on the base plate 45 of the main body as pivot shafts. These vertically movable members 46 and 48 are connected together by a connecting plate 49, while being adapted to be interlocked by a shaft member 50 so that they act in opposite directions to each other. On the upper surface of the vertically movable member 48, there is integrally mounted a vertical regulating member 48a for thrusting the head of a lever 43a secured to the rotary shaft of the stacked coin pressure arm 43 from above.

On the lower end of the member 46, passed through the base plate 45, a pin 46c is mounted upright and engaged in a recess 51a at one end of a vertical shift arm 51 rotatable about a pivot shaft 51b as center. At the other end of the arm 51 is mounted a roll 51c abutting on an adjacent inlet control cam 52 which in turn is driven by transmission means, not shown, connected to a rotary shaft of an inlet control electric motor 53.

Figure 8:
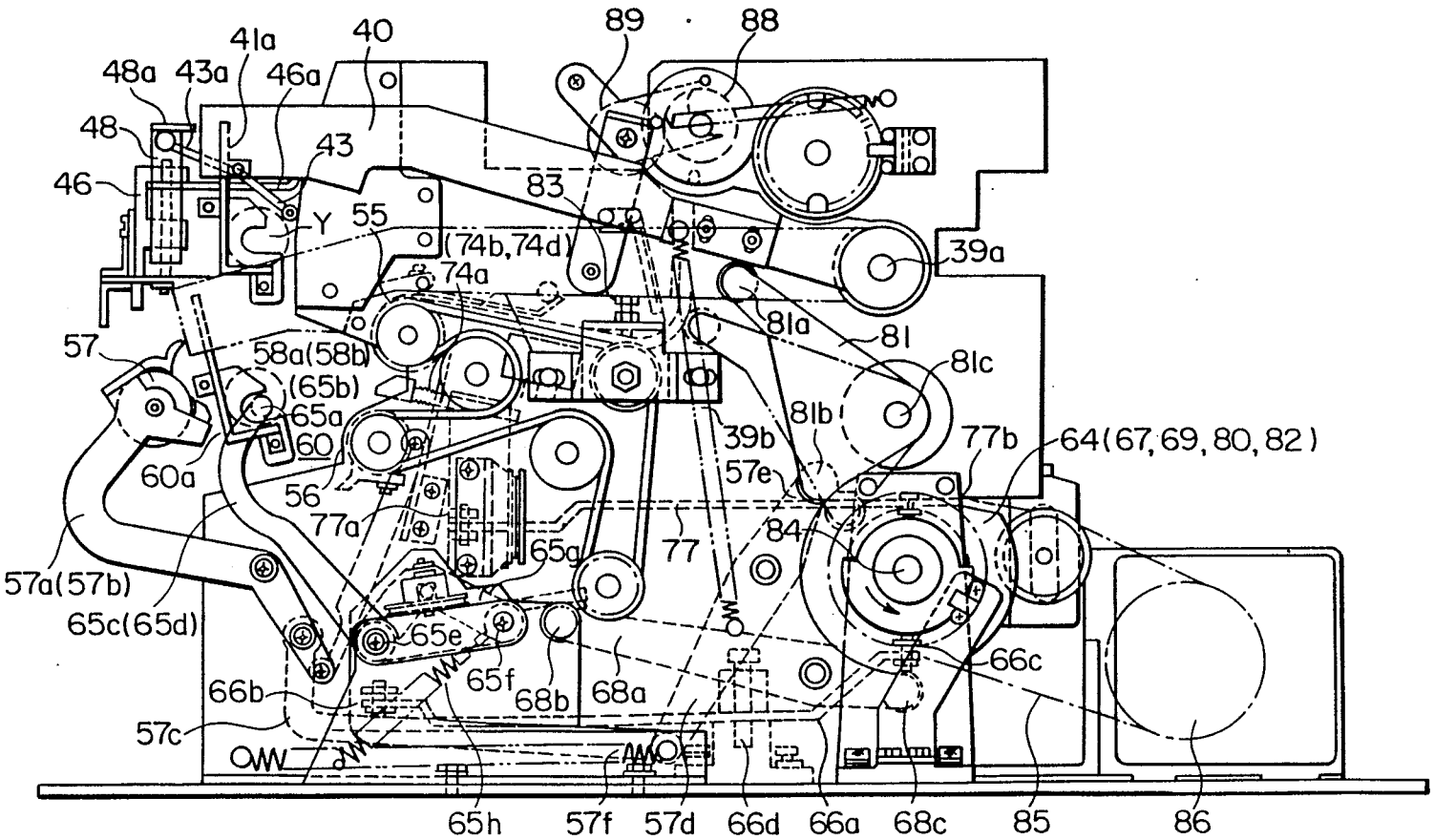
FIG. 8 is a diagrammatic side view showing essential parts of a coin packaging system.

On the lower side of the coin collecting section 41 of the transport unit, there are mounted, as shown in FIGS. 8 and 9, a stepped upper roll 55 and a stepped lower roll 56, for facing to the coin collector/stacker 41a when at the lower position. At back of a space 60a through which is shifted the coin collecting section, that is, at the lower position of the coin collector/-stacker 41a, there is mounted a shift roll 57 at some distance from rolls 55 and 56. Within the gap between the rolls 55 and 56, there are mounted a pair of pawls 59a and 59b that may be clamped to each other, and pawl holders 58a and 58b. The rolls 55 and 56, shift roll 57 and the pawls 59a and 59b make up a coin packaging section 60.

On the shaft ends of the rolls 55 and 56 are mounted drive pulleys 61a and 61b. These pulleys are connected to each other by a drive pulley 61c connected to a rotating shaft 62, a drive belt 63 and auxiliary pulleys 61d, 61e and 61f. A roll drive electric motor, not shown, is connected to the other end of the rotating shaft 62.

The shift roll 57 is mounted for rotation across the ends of a pair of roll shift arms 57a and 57b and also for shifting via a connecting arm 57c which is connected to the other ends of the roll shift arms 57a and 57b and which is urged in one direction by a spring 57f. To the other end of the connecting arm 57c is connected a second connecting arm 57d, to the end of which is mounted a roll 57e abutting on a cam for shift roll 64.

Figure 10:
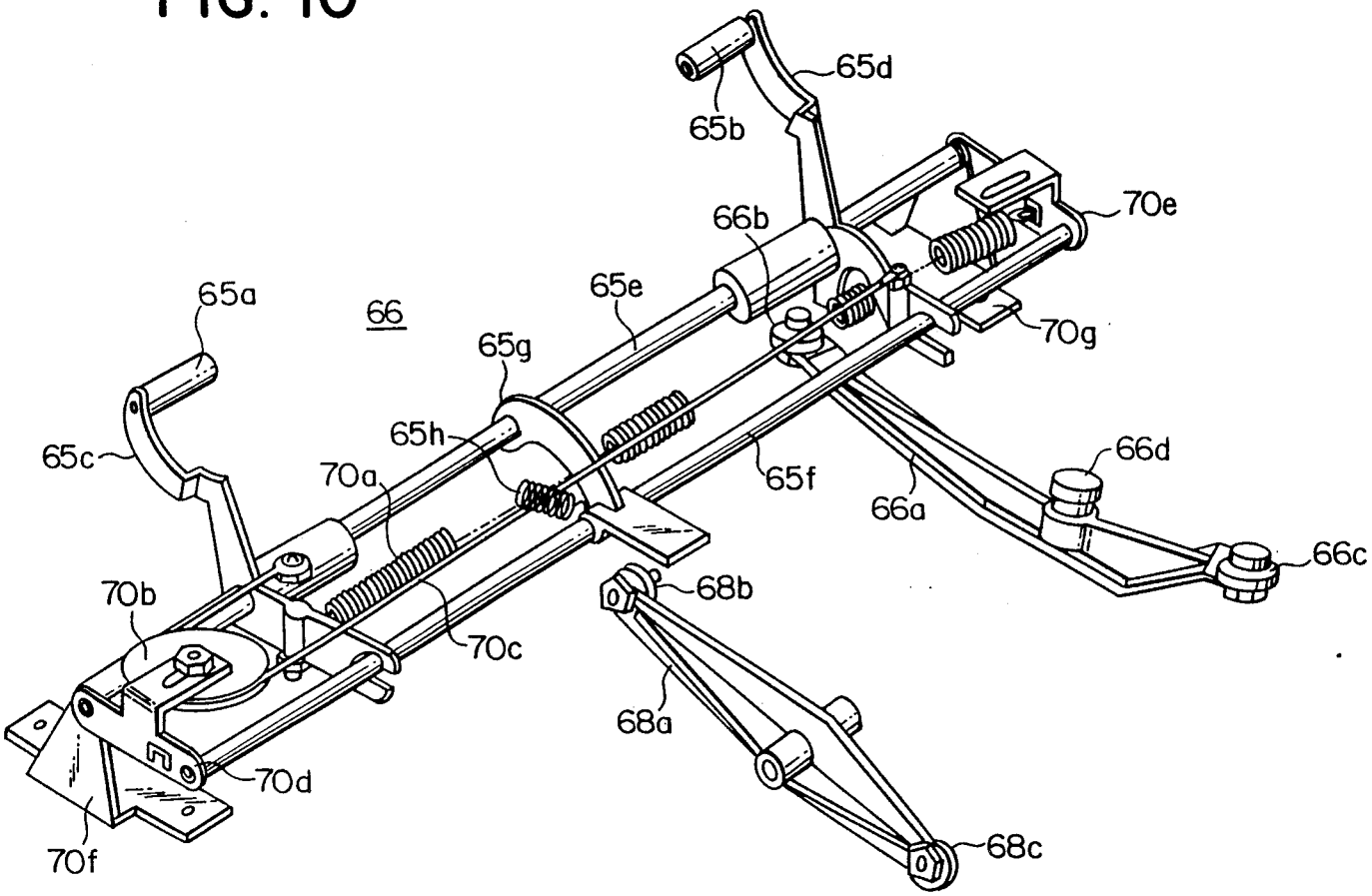
FIG. 10 is a perspective view showing the clamp system.

Adjacent to and below the coin packaging section 60, there are mounted, as shown in FIG. 10, a pair of supporting arms 65c and 65d at some distance from a fixed shaft 65e and a movable shaft 65f, mounted parallel to each other, such that the supporting arms may be shifted freely along shafts 65e and 65f. The ends of shafts 65e and 65f are secured to wire pulley mounting plates 70d and 70eand, on the top of the supporting arms 65c and 65d, there are integrally formed clamp pawls 65a and 65b for facing inwardly to each other. A spring is mounted under tension between the supporting arm 65c and the wire pulley mounting plate 70e. The supporting arms 65c and 65d are connected to each other by a wire 70c via a pulley 70b provided to the counterpart wire pulley mounting plate 70d such that the supporting arms 65c and 65d are drawn closer to each other under the action of the spring 70a. The end of the fixed shaft 65e is mounted for rotation to shaft member securing brackets 70f and 70g provided to the main member L. The movable shaft 65f is biased downwards by a spring 65h.

On the supporting arm 65d, provided with the clamp pawl 65b, there is abutted a roll 66b mounted for rotation to one end of an arm for clamp pawl 66a, the other end of which is provided with a roll 66c abutting on a clamp cam 67. The arm for clamp pawl 66a may be turned towards left or right about a pivot shaft 66d depending on the cam surface profile. The clamp pawls 65a and 65b are shifted along the axis of the fixed shaft 65e while a suitable distance is maintained between the pawls 65a and 65b.

At about the mid positions of the shafts 65e and 65f, there is mounted a swing lever 65g having at one end a plate-like projection which is abutted from the lower side by a roll 68b secured to one end of a swing arm 68a. A roll 68c provided to the other end of the swing arm 68a abuts on an arm swing cam 69 mounted coaxially with the clamp cam 67. The swing arm 68a is turned along the cam surface. The clamp pawls 65a and 65b may be moved along the direction of rolls 55 and 56 in the packaging section 60 via supporting arms 65c and 65d. The above described components make up a clamp unit 66.

Figure 11:
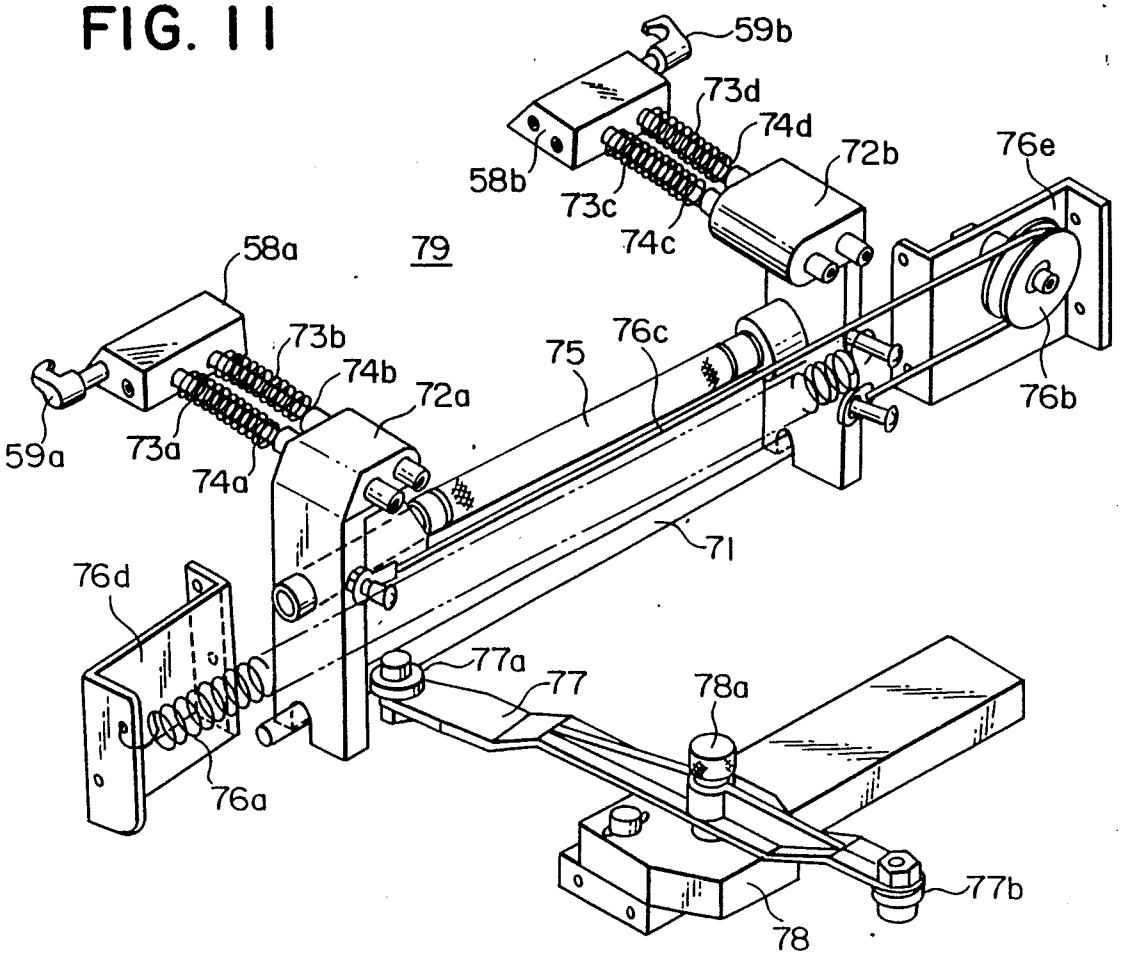
FIG. 11 is a perspective view showing the end face tightening section.

Adjacent to the coin packaging section 60 and at some distance from the supporting shaft 71, there are mounted, as shown in FIG. 11, a pair of pawl mounting blocks 72a and 72b so as to be shifted via a guide rod 75. On the top of these pawl mounting blocks 72a and 72b there are provided pairs of movable guide rods 74a–74b and 74c–74d, each wound by springs 73a–73b and 73c–73d. The foremost parts of guide rods 74a–74b and 74c–74d are provided with pawl holders 58a and 58b, while the pawls 59a and 59b that can be tightened to each other are mounted to the outer lateral sides of the pawl holders 58a and 58b.

Between the pawl mounting block 72b and the wire pulley mounting plate 76d secured to the base plate of the main body 1, a spring 76a is installed under tension. The pawl mounting blocks 72a and 72b are connected to each other by a wire 76c via a pulley 76b mounted to the counterpart wire pulley mounting plate 76e and are adapted to be drawn closer to each other under the force of the spring 76a. The pawl holders 58a and 58b are so designed and arranged that, when the coins are abutted during packaging on the rolls 55 and 56, the pawl holders necessarily projecting forward at this time are abutted, while the guide rods 74a–74b and 74c–74d are thrusted and shifted rearward against the force of the springs 73a–73b and 73c–73d to absorb changes in the thrusted state of the coins, at the same time that position adjustment may be made for the tightening of the coin bar by the pawls 59a and 59b that can be tightened to each other.

On the inner side of the pawl mounting block 72a, there is abutted a roll 77a provided to one end of a pawl shift arm 77 which is mounted for rotation by a pivot shaft 78a relative to the arm mounting block 78. The roll 77b provided to the other end of the shift arm 77 abuts on an end face processing cam 80 to cause the shift arm 77 to be turned towards left and right along the cam surface profile for tightening the pawls 59a and 59b. The pawl mounting blocks 72a, 72b, pawls 59a, 59b pawl holders 58a, 58b, guides rod 75 and the pawl shift arm 77 thus make up an end face tightening section 79.

On the other hand, the coin collector/stacker 41a integrally mounted to the holding arm 40 is maintained in the stationary state as it abuts on a roll 81a provided to one end of a movable arm 81 which is turned about a pivot shaft 81c, while a roll 81b provided to the other end of the shift arm 81 abuts on a cam 82 for shifting the coin collecting unit.

The cams 64, 67, 69, 80 and 82 are thus secured coaxially on a cam shaft 84 as a common shaft, and are adapted to transmit the driving of the packaging electric motor 86 to the cam shaft 84 in order to effect coordinated operations of the coin stacking section 41, coin packaging section 60, clamp section 66 and the end face tightening section 79.

On the end of the cam shaft 84, there is also provided a position sensing slitted disk, not shown, having a plurality of peripheral slits, and a position sensor 87 is provided in proximity to this position sensing slitted plate. On top of the rolls 55 and 56, making up the coin packaging section 60, there is provided a paper sheet feed unit 92, comprised of a pair of rolls 88 and 89, connected to a paper sheet feed electric motor, not shown, such that paper sheets 9 are supplied on the basis of output signals from paper sheet sensors 90a and 90b provided to the inlet and outlet of the paper sheet feed channel, in which a paper sheet cutter 91 is provided about halfway for cutting the paper sheets to predetermined lengths.

Below the coin packaging unit 60, there are provided a plurality of inclined discharge bars 94 contiguous to a coin discharge chute 93. The coins packaged in the coin packaging section 60, that is, the coin bar, is guided by these discharge bars 94 so as to be discharged to the outside via coin bar outlet 15 shown in FIG. 3. Below these discharge bars 94 is mounted the fractional number coin discharge vessel 14 adapted to receive coins dropped for some reason. A dropped coin sensor 96 is provided on the bottom of the vessel 14 to sense the coin drop to terminate the operation on the basis of the coin drop sensing signal.

The coin packaging device of the present invention, shown and described above, operates in the following manner.

When the power switch 12 is turned on, the program for controlling the various units or sections starts to be executed, and the device is initialized on the basis of an output signal from a controller, not shown.

On this occasion, when the pulley shift solenoid 37 is energized, the pulley 36a is shifted via pulley shift arm 36b towards the coin collecting section 41 to be slightly intruded into the recess 42a of the slider 42 of the coin collector/stacker 41a, while the pulley 36a faces to the lateral side of the side member 41f, for delimiting the coin collect start position.

When the fractional number coin discharge solenoid 34 is energized, the guide 33 causes the paired slide rods 33a to be slid and moved along the direction of an arrow mark T, the tension roll 32a abutting on the pulley 30c for closing an opening that is formed during the time of non-abutment, that is, a fractional number coin discharge opening 97, while simultaneously forming a coin feed passage 98.

On the other hand, for position adjustment in association with coin sorts established by the coin setting knob 2, the inlet control motor 53 is driven into rotation and the motor rotation is transmitted to an inlet control cam 52. Cam surface changes are converted via vertically movable arm 51 into vertical movements of the vertically movable member 46. The height of the coin feed channel 98 with respect to the collect start position by the pulley 30c and the coin collector/stacker 41a is regulated independent of the set coin diameter by the vertical control member 46a.

Then, in association with such movement of the vertically movable member 46, the counterpart vertically movable member 48 is caused to perform a vertical movement in the opposite direction by the connecting plate 49. Simultaneously, the lever 43a of the coin collector/stacker 41a is thrusted by the vertical control member 48a for similarly controlling the height of the collected coin presser arm 43 adapted for holding the coins X during coin collection and stacking to a height corresponding to the coin diameter.

When the start switch 46 is then turned on, the count motor, not shown, is driven into operation by revolving the turntable 16. The motor rotation is transmitted via other transmission means, not shown, to transport belts 17c and 30d. When the turntable 16 is revolved, the coins X despatched under the centrifugal force are conveyed in the coin passage 18 under thrusting by the transport belt 17c. The small-diameter coins other than the designated coins are dropped through sort opening 20 in the profile select section 19 so as to be discharged into the reject coin receiving vessel 13 by discharge chute, not shown. The designated coins are then guided to the star gear 21 and the number of the transported designated coins is sensed by the coin count sensor 25 by the operation of the stop wheel 22 interlocked for rotation with the star gear 21. The sensed signals are continually temporarily displayed on the count member display section 4 via count section, not shown.

The coins X transported from the coin passage are fed to the coin invert section 30 after the coin material is sensed by the coin material sensor 29. In the coin invert section 30, the coins are guided, as shown in FIG.

2, by the guide plate 30e, inverting block 30a having a three-dimensional curved surface and the transport belt 30d mounted for rotation across paired pulleys 30b and 30c. The coins supplied initially in the prone or horizontal position are inverted 90° when travelling along the curved surface 30a so as to be erected to an upright position. When arriving at the pulley 30c, the coins are clamped for transport in this upright position between the pulley 30c and the tension roll 32a acting on the other sides of the coins.

The coins X thus transported as they are clamped between the pulley 30c and the tension roll 32a then get to the coin stacking start position by the pulley 36a and the slider 42 of the coin collector/stacker 41a, while the passage is controlled in its height. Then, under the rotating force ascribable to the biased state of the pulley 36a, the coins are sequentially transported while thrusting the lateral side of the slider 42 against the force of the spring 41e acting along the direction of the arrow mark H, such that the coins are stacked on the coin collector/stacker 41a in the juxtaposed intimately contacting upstanding state between the lateral side member 41f and the slider 42. These stacked coins are referred to hereinafter as the coin stack.

As the coins X are collected and stacked on the coin collector/stacker 41a, the number of the coins is counted by a coin count sensor 25. When a predetermined number of, such as fifty, coins are despatched, rotation of the star gear 21 is stopped by commands from the controller, not shown, based on the sensed signal, for terminating further despatching of the succeeding coins. As the coin count sensor, not shown, provided to the base plate 33 of the tension roll unit 35, has checked that the predetermined number of coins has been collected without fail at the coin collector/stacker 41a, the drive operation of the count motor is terminated. Simultaneously, the drive operation of the pulley shift solenoid 37 is terminated and the pulley 36a is returned from the coin collector/stacker 41a to its original position.

When it has been confirmed that the drive members have been restored to their starting position and that there are no dropped coin or coins at the dropped coin sensor 96, the packaging electric motor 86 is driven into revolutions. The coin collecting section shift cam 82 is first turned to turn the shift arm 81 to turn and shift the coin collecting section holding arm 40 downwards. When the coin collector/stacker 41a starts to be moved downwards with such movement, the lever 43a is released from the state of abutment with the vertical regulating member 48a, so that the biasing force of the spring 43b is enabled to cause the stacked coin presser arm 43b to abut on and hold the upper side edge of the coin stack Y. On the other hand, the coin collector/-stacker 41a is guided into the space 60a in which the coin collecting section of the coin packaging section 60 is moved, until it is stopped in contact with stop bar 83 mounted upright at the belt adjustment section for the auxiliary pulley 61f.

After completion of the movement of the coin collector/stacker 41a, the arm for clamp pawl 66a is turned as a result of rotation of the clamp cam 67, such that the paired supporting arms 65c and 65d are shifted in the width narrowing direction under the biasing force of the spring 70a. Thus, as shown in FIG. 8, the coin stack Y on the coin collector/stacker 41a is clamped from both sides by clamp pawls 65a and 65b. After such clamping, the arm swing cam 69 is turned to turn the swing arm 68 such that the projection of the swing lever 65g is moved down under the force of the spring 65h about the stationary shaft 65e as the pivot shaft. In association with such operation, the supporting arms 65c and 65d are shifted towards the upper and lower rolls 55 and 56, as the coin stack Y is clamped by clamp pawls 65a and 65b.

When the coin stack Y is brought by such shifting of the supporting arms 65c and 65d into abutment with the rolls 55 and 56, the shift arm 81 is turned towards the starting position as a result of the turning of the shift cam 82. As a result, the holding arm 40 starts to be shifted upwards, while the coin collector/stacker 41a is returned to its original position.

When the cam for shift roll 54 is turned to turn the connecting arm 57d at the same time that the coin collector/stacker 41a is returned to its starting point, the roll shift arms 57a and 57b are shifted towards the rolls 55 and 56 under the force of the spring 57f via counterpart connecting arm 57c, such that, as shown in FIG. 9, the shift roll 57 abuts on the coin stack Y. As the roll 57 abuts on the coin stack in this manner, the coin stack Y is clamped by the upper roll 55, lower roll 56 and the shift roll 57. Then, due to turning of the clamp cam 57, the arm for clamp pawl 66a is turned towards the starting position to thrust the supporting arm 65d outwards to increase the distance between the supporting arms 65c and 65d to the original arm width against the force of the spring 70a via wire 70c and pulley 70b to release the clamp pawls 65a and 65b from the coin stack clamping state. The clamp pawls 65a and 65b are then retained in this position to establish the standby state.

As the clamp pawls 65a and 65b are receded, the roll drive motor, not shown, is driven into revolutions and the motor rotation is then transmitted via auxiliary pulleys 61c, 61a, 61e and 61f and drive belt 63 to drive pulleys 61a and 61b associated with the roll 55 and 56. In this manner, the upper and lower rolls 55 and 56 and the shift roll 57 start to be turned, as the coin stack Y is in the clamped state, and the packaging paper 9 is wrapped a desired number of times on the periphery of the coin stack Y.

For, feeding the packaging paper 9, the paper feed motor, not shown, is driven into revolutions for a predetermined time simultaneously with the downward movement of the holding arm 40, such that the packaging paper 9, so far in the standby state at the position of the paper sensor 90b, is previously fed on the upper and lower rolls 55 and 56 by a predetermined length. The operating timing is so set that the leading edge of the packaging paper 9 is correctly positioned during the time that, after the coin collector/stacker 41a is lowered, the coin stack Y is clamped from both sides by the clamp pawls 65a and 65b and extracted towards the rolls 55 and 56. In this manner, the leading edge of the packaging paper 9 is clamped by the coin stack Y, rolls 55, 56 and the shift roll 57 as the shift roll 57 is shifted further after the coin stack Y in the clamped state between the clamp pawls 65a and 65b has been shifted towards the upper and lower rolls 55 and 56.

At this time, when the rolls 55, 56 and the shift roll 57 start to be revolved, as described above, the packaging paper 9 extending between the roll on the top of the main body 1 and the coin stack Y is stretched in the paper feed passage and cut when abutting on the paper cutter 91. Thus the portion of the packaging paper 9 remaining after such cutting is continuously wrapped around the coin stack Y.

When the packaging paper 9 is cut, the output from the paper sensor 90*b* is turned off. The paper feed motor is revolved until next the paper sensor 90*b* is turned on. The packaging paper 9 is in the standby state at this position, as described hereinabove. The leading edge of the paper 9 is located in position on the rolls 55 and 56 at the timing of descent of the coin stacker 41*a*.

In association with the wrapping of the packaging paper 9 around the coin stack Y, the end face processing cam 80 is turned to turn the pawl shift arm 77 to shift the pawl mounting blocks 72*a* and 72*b* gradually in the width narrowing direction. Simultaneously, both ends of the packaging paper 9 in the wrapped state are bent inwards and tightened by tightening pawls 59*a* and 59*b* to produce the coin stack Y wrapped by the packaging paper 9, that is, the coin bar.

After the formation of the coin bar, the tightening pawl shift arm 77 is turned towards the starting point to thrust the pawl mounting block 72*a* outwards to increase the distance between the pawl mounting blocks 72*a* and 72*b* to the original arm width, via wire 76*c* and pulley 76*b*, against the force of the spring 76*a*, for releasing the tightening pawls 59*a* and 59*b* from the tightening position on both ends of the coin bar. At this time point, the connecting arm 57*d* is turned on the basis of the shift roll cam 64, while the connecting arm 57*c* and the roll shift arms 57*a* and 57*b* are receded towards the rear against the force of the spring 57*f* to return the shift roll 57 to its starting position. Then, following the turning of the shift roll cam 64, the arm swing cam 69 is turned to turn the swing arm 69*a* towards its starting position to shift the projection of the swing lever 65*g* upwards, at the same time that the associated supporting arms 65*c* and 65*d* are moved towards the rear to return the clamp pawls 65*a* and 65*b* to their starting positions.

As the shift roll 57 is returned to its starting position, the coin bar is released from clamping by the upper and lower rolls 55, 56 and the shift roll 57, so that it descends by gravity on a coin discharge chute 93 away from the coin packaging section 60 onto the coin discharge chute 93 provided below the space 60*a* set aside fro the coin collecting section. The coin bar is then slid on the inclined surface and on the discharge bars 94 so as to be taken out at the coin bar outlet 15.

What is claimed is:

1. A coin packaging device for transferring and collecting coins despatched from a turntable, counting, transporting and packaging said coins in groups each containing a predetermined number of said coins, said device comprising in combination coin profile sorting means for sorting a designated coin from coins transported thereto from a turntable, counting means for counting the number of said sorted coins passed by said profile sorting means, a coin passage having a warped surface, a transport belt mounted adjacent said coin passage cooperating with said warped surface for transporting said sorted coins from said profile sorting means along said warped surface for erecting said sorted coins from a prone to an upstanding position, a coin collecting section having a coin collector/stacker for accommodating said coins in an intimately contacted aligned upstanding position to form a bar of said coins, means for transporting said coins between said warped surface and said collector/stacker, transfer means for moving said coin collector/stacker to a predetermined location and transferring said coin bar of intimately contacted aligned upstanding coins from said collector/stacker to a packaging station, and packaging means at said packaging station including a plurality of horizontally disposed rolls and a pair of end engaging pawls for respectively rolling a wrapper around said coin bar and folding over the ends of said wrapper.

2. A coin packaging device as claimed in claim 1, wherein said means for transporting said coins between said warped surface and said collector/stacker comprises a tension roll arm supporting a tension roll for engaging and supporting said coins on said collector/-stacker.

3. A coin packaging device as claimed in claim 1, wherein said transfer means comprises a clamp unit with a pair of supporting arms each including a pawl for engaging an end of a coin bar.

4. A coin packaging device as claimed in claim 1, wherein said collector/stacker includes a presser arm for pressing against and supporting the coins on edge in said coin bar on said collector/stacker.

* * * * *